United States Patent [19]

Leroy

[11] 3,990,890

[45] Nov. 9, 1976

[54] PROCESS FOR REFINING MOLTEN COPPER MATTE WITH AN ENRICHED OXYGEN BLOW

[75] Inventor: Pierre Leroy, Saint-Germain-en-Laye, France

[73] Assignee: Creusot-Loire, Paris, France

[22] Filed: June 27, 1975

[21] Appl. No.: 591,080

Related U.S. Application Data

[63] Continuation-in-part of Ser. No. 354,400, April 25, 1973, abandoned.

[30] Foreign Application Priority Data

May 17, 1972 France ..... 72.17620
Feb. 26, 1973 France ..... 73.06685

[52] U.S. Cl. ..... 75/76; 75/72
[51] Int. Cl.[2] ..... C22B 15/00
[58] Field of Search ..... 75/76, 75, 74, 73, 72, 75/60; 266/35, 41

[56] References Cited

UNITED STATES PATENTS

| | | | |
|---|---|---|---|
| 2,708,572 | 5/1955 | Hudson et al. | 266/35 |
| 3,326,672 | 6/1967 | Worner | 75/76 |
| 3,432,289 | 3/1969 | Spitz et al. | 75/76 |
| 3,604,698 | 10/1969 | Themelis | 266/34 T |
| 3,608,880 | 9/1971 | Gombert et al. | 266/41 |
| 3,632,335 | 1/1972 | Worner | 75/76 |
| 3,706,549 | 12/1972 | Knuppel et al. | 75/60 |
| 3,781,002 | 12/1973 | Courard | 266/41 |
| 3,817,744 | 6/1974 | Leroy et al. | 75/60 |

FOREIGN PATENTS OR APPLICATIONS

| | | | |
|---|---|---|---|
| 1,450,718 | 7/1966 | France | 266/41 |

*Primary Examiner*—Walter R. Satterfield
*Attorney, Agent, or Firm*—Robert D. Yeager

[57] ABSTRACT

A process for refining molten copper matte in a refractory-lined converter having at least one double tuyere located beneath the surface of the molten bath by injecting an oxidizing gas into the matte through the tuyere at a pressure in the range of 6 to 20 bars while also injecting therethrough a cooling agent peripherally of the oxidizing gas. During a first phase of the refining, the oxygen content of the oxidizing gas is varied as necessary up to pure oxygen to maintain the temperature of the matte in the range of 1280° C to 1420° C and still promote sufficient stirring of the molten bath by the injected oxidizing gas. Thereafter, the matte is blown with an oxidizing gas highly enriched with oxygen for a second phase of the refining while still maintaining the temperature in the aforementioned range by adjusting the oxygen content of the oxidizing gas.

8 Claims, 3 Drawing Figures

PROCESS FOR REFINING MOLTEN COPPER MATTE WITH AN ENRICHED OXYGEN BLOW

CROSS REFERENCE TO RELATED APPLICATIONS

This is a continuation-in-part of U.S. application Ser. No. 354,400, filed Apr. 25, 1973 and now abandoned.

BACKGROUND OF THE INVENTION

1. Field of the Invention

This invention relates to a process for refining copper-containing mattes by blowing such mattes with an oxidizing gas rich in oxygen while injecting a cooling agent peripherally of the oxidizing gas.

2. Description of the Prior Art

It is well known that copper matte can be converted to copper metal (in an impure form known as "blister" copper) by oxidizing the iron and sulfur contained in the matte. The conversion is commonly carried out in a horizontal, rotating cylindrical furnace known as a Pierce-Smith converter. This converter has a basic refractory lining, usually of magnesia, with tuyeres embedded in the refractory for introducing blasts of air or oxygen-enriched air into the molten copper matte from beneath its surface. The blast blown through the tuyeres, which consist of single tubes, cannot be enriched beyond about 36% of oxygen without causing rapid erosion of the turyeres and the surrounding refractory. Even in observing this maximum oxygen content of the blast, refractory consumption in the Pierce-Smith converter is relatively high; for example, in the range of 2 to 5 kg per ton of copper refined.

Conventional copper matte refining processes present other operating problems, one of which being proper control of the matte temperature during refining. In the conversion of copper matte by blowing with an oxidizing gas, it is known that the matte temperature must be maintained between 1220° C and 1350° C. Below 1220° C, the slag formed during the process is too pasty for proper working and removal. If, on the other hand, the matte temperature exceeds about 1350° C, the refractory lining of the converter, particularly in the tuyere zones, is worn too rapidly.

Maintenance of the temperature within this relatively narrow range (about 130° C) is complicated by the required refining procedures; namely, that the refining operation must be interrupted at intervals to remove slag and introduce further amounts of matte and other additions into the converter. Such an interruption, coupled with the addition of matte which may often be cool, causes the temperature of the molten furnace charge to tend toward the low side of the practical working temperature range of 1220° C to 1350° C. It is well known, of course, that such lower temperatures favor the formation of magnetite ($Fe_3O_4$) as a result of the oxidation of iron sulfide (FeS).

The presence of magnetite in the molten bath has a further chilling effect on the matte, so the formation of magnetite and its deposition on the refractory lining is to be minimized from the standpoint of heat balance. Furthermore, the deposited magnetite tends to gradually clog the tuyeres, particularly at the relative low blowing pressures used in conventional processes; this necessitates periodic unclogging of the tuyeres by pushing rods through them during periods when blowing is stopped.

Magnetite formation poses additional problems for the operator. For example, magnetite tends to thicken the slag and thereby cause the well-known operating difficulties associated with a thickened slag. Magnetite production also tends to increase the copper content of the slag with a corresponding reduction in yield. Magnetite formation is especially prevalent where copper-rich mattes (i.e. those containing 60% copper or more) are to be refined because the iron content of such mattes is relatively low and the heat balance of the operation is correspondingly less desirable. Of course, the formation of magnetite and the attendant reduction in bath temperature result in other unfavorable process conditions such as the difficulty encountered in removing elements like arsenic and bismuth from the matte.

Even though workers in the art may have recognized the desirability of carrying out the conversion of copper mattes in a temperature range higher than theretofore attainable, the attempts to reach higher temperatures have been limited to such well known expedients as localized heating of the converter lining, for example with an oxyfuel lance, when blowing is stopped; this technique, however, does not really address the problem because the heating step does not occur simultaneously with the refining operation.

SUMMARY OF THE INVENTION

The present invention overcomes the problems experienced in copper matte conversion processes. By injecting a cooling agent peripherally of the oxidizing gas while blowing the oxidizing gas at much higher pressures than those used in the prior art processes, the oxygen content of the oxidizing gas can be increased far beyond the limits previously imposed in copper matte conversion processes without undue wear on the tuyeres and surrounding refractory. The cooling agent, which preferably is fuel oil, helps to protect the tuyeres and refractory from the eroding influence of oxygen and its reaction products as the jets of oxidizing gas emerge from the tuyeres.

The present invention thus permits the oxygen content of the oxidizing gas to be varied up to the point where pure oxygen may be injected into the copper matte. Several benefits, heretofore unattainable in copper matte conversion processes result: (i) Since the oxidation reactions that occur in the matte are exothermic and higher concentrations of oxygen are available for reaction, the tmperature of the matte can be raised and maintained above 1280° C; this is the temperature at which ferrous oxide (FeO) formation, rather than magnetite, is favored and the FeO thus formed is taken into solution in the slag; (ii) The overall time required for the refining process is substantially reduced; (iii) The higher matte temperatures improve slag working and handling; and (iv) Tuyere blockages are avoided by enriching the oxygen content of the blast instead of by stopping the refining operation and mechanically unclogging the tuyeres as in conventional practice.

The present invention provides a process for refining molten copper matte in a refractory-lined converter having at least one double tuyere located beneath the surface of the molten bath, which process comprises the steps of: injecting an oxidizing gas into the matte through the tuyere at a pressure in the range of 6 to 20 bars while also injecting therethrough a cooling agent peripherally of the oxidizing gas; varying as necessary during a first phase of the refining the oxygen content of the oxidizing gas within a range up to pure oxygen to maintain the temperature of the matte in the range of 1280° C to 1420° C and still promote sufficient stirring of the molten bath; and thereafter blowing oxidizing gas highly enriched with oxygen for a substantial period of a second phase of the refining while still maintaining the temperature of the matte in the aforesaid range by adjusting the oxygen content of the oxidizing gas. The invention further provides that the cooling agent is a carbon-containing material, preferably fuel oil. Preferably, the oxygen content of the oxidizing gas is varied during the first and second phases of refining to maintain the temperature of the matte in the range of 1350° C to 1400° C. The term "highly enriched with oxygen" as used herein may be taken to mean having an oxygen content of 40% or greater.

Other features and advantages of the present invention will become apparent as the following detailed description, taken with the accompanying drawings, proceeds.

DESCRIPTION OF THE PREFERRED EMBODIMENTS

The refining of copper matte in a converter involves two distinct phases: a first phase during which the iron in the matte is oxidized and removed from the molten bath by the slag; and a second phase during which the sulfur in the matte is oxidized to sulfur dioxide gas ($SO_2$) which is released from the bath.

During the iron oxidation phase of the refining operation, blowing is stopped at intervals to remove slag and to complete the charge by adding copper matte and cooling agents such as copper scrap, alloys, concentrates and one. Slag forming materials such as silica may also be added during these interruptions. Also during the iron oxidation phase, it is desirable to glaze the basic refractory lining of the converter with a protective coating of magnetite. This is generally accomplished at the beginning of refining by blowing ordinary air into the matte so that the matte is kept at a low temperature favorable to magnetite formation; i.e. between about 1220° C to 1280° C. The blowing is stopped and the converter is rotated to allow the liquid magnetite to deposit on the converter lining and thus glaze it. Normal blowing operations are then resumed but re-glazing may be necessary during the iron oxidation phase of refining and this is advantageously performed during the regular blowing stoppages for slagging off, etc.

At the end of the iron oxidation phase, the matte is substantially free of iron but still contains sulfur; this product is commonly referred to as "white matte" ($CU_2S$). The second phase of refining — desulfurization — is then accomplished in a single step by blowing an oxidizing gas highly enriched with oxygen up to pure oxygen (commercially pure oxygen having an oxygen content of 99% or greater) to oxidize the sulfur by the well known reaction of copper and oxygen to form copper oxides which further react with the copper sulfides in the matte to release $SO_2$ gas. The product remaining in the bottom of the converter after desulfurization is impure blister copper.

Figure 1:
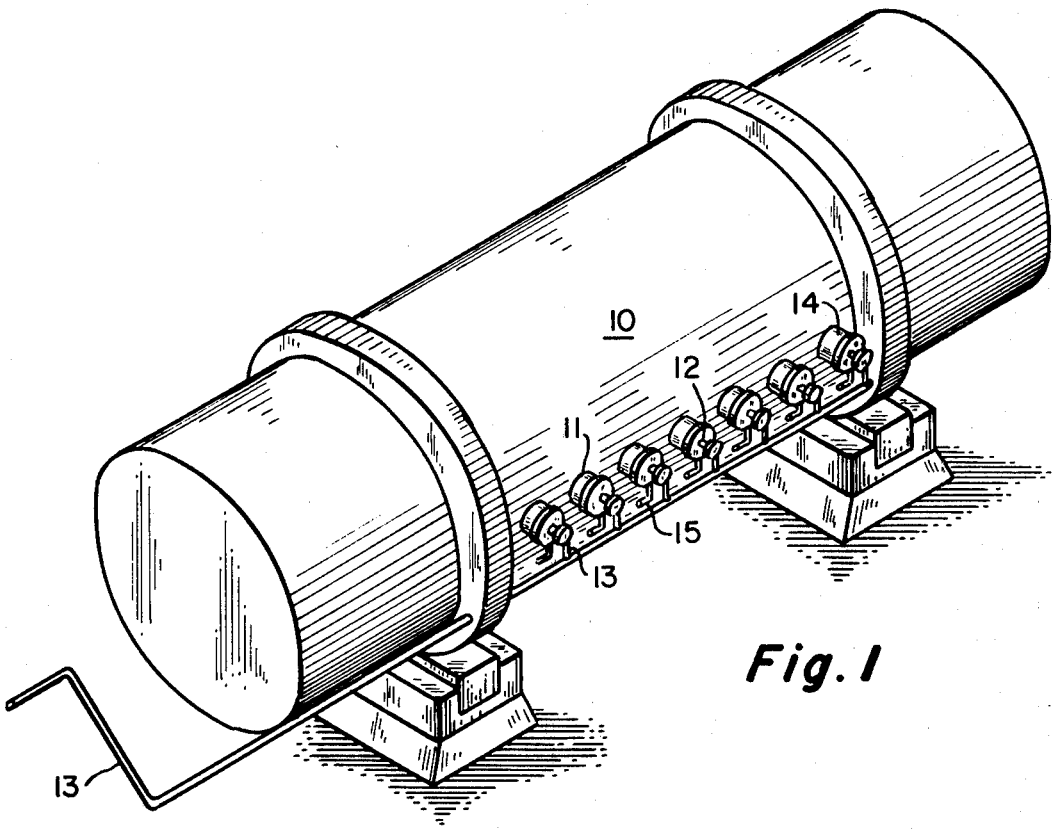
FIG. 1 is a perspective view of a converter having a plurality of double tuyeres.
Figure 2:
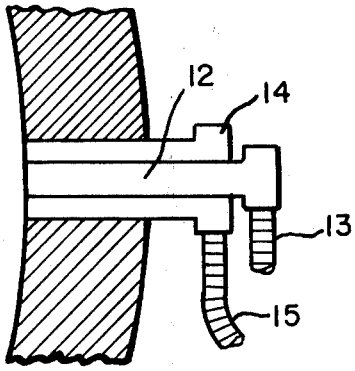
FIG. 2 is a sectional view through one of said tuyeres.

Referring now to FIG. 1, there is shown a converter 10 suitable for use in carrying out the process of the present invention. The converter is lined with a basic refractory material which may be magnesia or chrome-magnesia, or preferably tarred dolomite which is less expensive than magnesia refractories. Typically, the converter may be a horizontal cylinder as shown. For obtaining 10 tons of blister copper using the present invention, the converter has a diameter of 3 meters and a length of 5.30 meters. A series of horizontally aligned tuyeres 11 are installed in the wall of converter 10 at a location which permits the tuyeres to be submerged below the surface of the molten copper matte during blowing operations. Each tuyere 11 is a double tuyere, that is consisting of two concentric pipes as shown in FIG. 2. The inner pipe 12 is connected by means of flexible line 13 through a manifold to a supply of oxidizing gas. The outer pipe 14 is separately connected through flexible line 15 to a supply a domestic fuel oil. Each separate fuel oil supply means includes a pump, and pressure and flow rate instrumentation to permit the control of the supply of cooling agent to each individual tuyere. Details of the construction and operation of the double tuyeres used in the process of the present invention are disclosed in U.S. Pat. No. 3,817,744 whose teachings in that regard are incorporated herein by reference.

The cross-section of the inner pipe of the tuyeres, the thickness of the inner and outer pipes of same, and the number of tuyeres are selected to acieve blowing pressures in the range of 6 to 20 bars, preferably 6 to 12 bars, which pressures are significantly greater than the pressure range of 0.7 to 1 bar used in conventional copper matte conversion processes. This increased blowing pressure is essential to the efficient operation of the present invention as explained more fully hereinbelow. By blowing at pressures on the order of 10 times higher than in conventional processes, the cross-sectional passage area of the tuyeres may be correspondingly reduced to achieve a given flow rate of oxidizing gas. This reduction in tuyere cross-sectional passage area may be manifested in the present invention by a reduction in the diameter of the axial tube of each tuyere, a reduction in the total number of tuyeres, or both. Since the tuyeres used to the present invention are double tuyeres, it is important, from the standpoint of the construction costs for both the tuyeres and their feed circuits, that they be kept few in number. The number of tuyeres employed should be between 5 and 12, preferably not more than 15.

Blowing oxidizing gas at the pressures used in the present invention causes a rapid expansion of the gas as it emerges from the tuyeres and thus an increase in gas velocity. The expanding gas also has a cooling effect on the tuyere which complements the cooling effect of the peripherally injected cooling agent. This combined cooling effect permits the process of the present invention to operate in the higher temperature range (i.e. 1280° C to 1420° C) without the concomitant rapid erosion of the tuyeres and surrounding refractory experienced in the prior art processes employing low blowing pressures and single tube tuyeres.

Furthermore, the increasing blowing pressure of the oxidizing gas provides a corresponding increase in the force of the gas stream acting on the molten bath for any given flow rate. The mechanical agitation of the bath caused by the impact of the gas stream results in a stirring of the bath which greatly contributes to the kinetics of the reactions in the refining process, expecially during the iron oxidation phase where little gas is evolved from within the bath itself. Accordingly, the significantly higher blowing pressures used in the present invention in part account for a marked reduction in the time required to complete the refining operation.

Another important feature of the process of the present invention is the ability to vary the oxygen content of the oxidizing gas from ordinary air (21% oxygen) up to pure oxygen. In the practice of the invention, the oxygen content is usually varied between about 40% oxygen and pure oxygen depending upon the process conditions. For example, during the iron oxidation phase of the process, each blowing period may commence with the blowing or ordinary air to foster magnetite formation for the purpose of glazing the refractory lined as described above. Immediately thereafter, pure oxygen is blown to restore the temperature of the matte as soon as possible to within the range of 1280° C to 1420° C, preferably 1350° C to 1400° C, and thereby eliminate further magnetite formation. Any tendency of the magnetite formed initially to clog the tuyeres is minimized by the blowing of pure oxygen because the heat generated in the tuyere zones by the exothermic oxygen-metal reactions removes any solidified deposits in those zones. Accordingly, the need for mechanical unclogging procedures, often resorted to in the prior art processes, is eliminated with resultant savings in the time required to complete the refining operation. It will be appreciated that the tuyeres may be unclogged at any time during refining by blowing pure oxygen.

Figure 3:
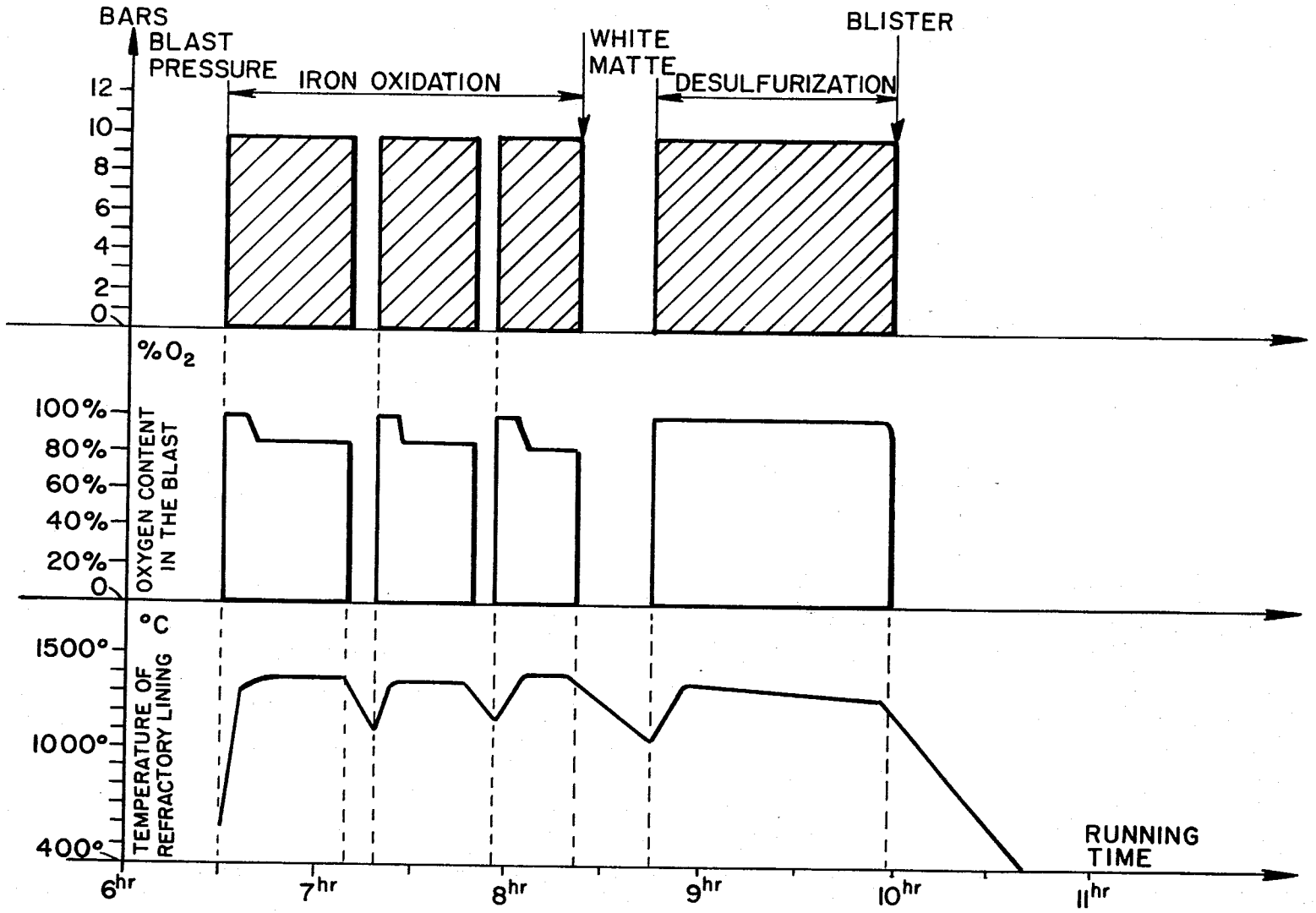
FIG. 3 is a three-part graphical showing of a typical blowing schedule for the present invention.

Following an initial period of blowing with purer oxygen or highly enriched air, the oxygen content of the oxidizing gas is reduced to between 40% to 90% oxygen until an interruption of the blowing period is required. The reason for this preferred reduction in oxygen content of the blast is that during this phase of the process, iron is oxidized in preference to sulfur and the generation of gas within the bath is at low level. Consequently, the bath would be relatively calm but for the stirring action caused by the nitrogen component of the air as it passes upwardly through the bath. During the desulfurization phase of refining, there is a strong evolution of $SO_2$ in the bath which creates food turbulence within the bath and, therefore, highly enriched air and preferably pure oxygen may be blown in this phase depending upon the amount of cooling additions present. FIG. 3 graphically illustrates a typical blowing schedule for use in the process of the invention; the middle graph of that FIG. illustrates the variations in oxygen content of the oxidizing gas available to the operator of the process.

Regulation of the temperature of the copper matte during each stage of conversion is achieved by varying the flow rate and oxygen content of the oxidizing gas and by making cooling additions. A skilled operator using these variables is thus able to maintain the matte temperature within the desired range of 1280° C and 1420° C, and more preferably between 1350° C and 1400° C. The temperature of the matte naturally decreases during blowing stoppages but, as explained above, may be rapidly brought within the preferred range when blowing is resumed. The lowermost graph of FIG. 3 illustrates a typical temperature profile for the refractory lining during the production of one heat using the process of the invention.

Numerous advantages accrue by carrying out the conversion of copper mattes by the process of the invention. The time to complete a refining operation is materially reduced compared with conventional processes; the order of magnitude of the reduction may range up to about 50 percent. The use of pure oxygen or highly enriched air leads to a much more favorable heat balance than in known processes and this makes possible the re-melting of a wide variety of copper-containing products such as scrap, concentrates, ores and the like. The process of the invention causes a marked increase in the $SO_2$ content of the converter exhaust gases which facilitates the production of sulfuric acid as a by-product of the process. Further, the process affords an improvement in the yield of copper from the refining operation. It is understood, of course, that the copper mattes which can be refined by the process of the invention may vary widely in copper content and may include other recoverable metal values as well.

The present invention will be further understood by reference to the following non-limiting example: The objective is to refine a matte containing 35% copper in order to obtain 10 tons of blister copper at the end of the refining operation. A converter configured as in FIG. 1 and having the dimensions set forth above is used as the vessel for refining. One row of seven double tuyeres is arranged along one of the horizontal generating lines of the converter. Each tuyere consists of two concentric tubes, the inner tube having an inside diameter of 15 mm. The tuyeres are connected to supplies of oxidizing gas and fuel oil as described above.

Fifteen tons of copper matte are changed to the converter together with an appropriate quantity of cuprous cooling additives as determined by the operator and a similarly determined quantity of silica for slag forming. The silica, crushed to a particle size of 70–80 mm, is injected into the converter by means of an air gun. If the refractory lining requires magnetite glazing, that operation will be carried out as previously described and the silica addition will be made only after the completion of glazing. The blast of oxidizing gas is then turned on and pure oxygen is blown at a pressure of 10 bars for several minutes to raise the temperature of the matte above 1280° C to the optimum region of 1350° to 1400° C. The oxygen content of the blast is then lowered to 85% oxygen and blowing is continued for a period of 15 to 40 minutes as determined by the melt conditions as judged by the operator. The blow is stopped and the iron silica slag is skimmed from the converter into a ladle. The mount of the converter is cleaned and more liquid matte is charged along with the required amount of cooling additions and silica. The blow is then resumed by repeating the steps described above as necessary. Following the second blowing period for iron oxidation, a third blowing period is required in this case to complete iron removal. Thereafter, the blow is resumed for the desulfurization phase of the operation. The blowing pressure is again 10 bars but now pure oxygen is blown as the oxidizing gas because sufficient cooling additions are present in the melt to prevent the matte temperature from becoming excessive; otherwise, highly enriched air would be blown. The desulfurization blowing phase requires about 75 minutes to complete.

A total of 28 tons of copper matte and 18 tons of cold additions were changed during the refining operation to produce 10 tons of blister copper. A total of 20 tons of slag is produced during refining as well as a certain amount of white matte. The total duration of the refining period was 4 hours and 15 minutes which favorably compares with the 8 hour period required to refine the same quantity of copper in a conventional converter blowing ordinary air under a pressure of 0.7 to 1 bar through 22 single tube tuyeres having an inside diameter of 38 mm. The refining time for the present invention breaks down to 2 hours and fifteen minutes of actual blowing time and 2 hours of stoppages. The blowing schedule for this example appears in FIG. 3.

The foregoing example may be compared with the conventional converter mentioned in the preceding paragraph as follows:

1. Cross-sectional area of each tuyere according to the invention: 7 times smaller than the cross-sectional area of a conventional tuyere.
2. Number of tuyeres according to the invention: 3 times fewer.
3. Blowing pressure: 10 times greater.
4. Oxygen content of the blast: 4.5 times higher.
5. The flow of rate refining oxygen is thus $10 \times 4.5/7 \times 3 =$ twice as great in the present invention as in a conventional converter.
6. The consumption of oxygen is decreased relative to the 1,300 $Nm^3$ per ton of copper necessary in conventional converters because of the increased capability of melting solid additions, some of which provide oxygen.
7. The time of blowing stoppages is reduced because (i) unclogging of the tuyeres is eliminated and (ii) racking out of the slag is performed more rapidly due to its higher temperature (fluidity) and the absence of magnetite in the slag.

The total consumption of fuel oil in the foregoing example was 1,050 liters, corresponding to 105 liters per ton of copper refined, at a flow rate of 1.1 liters/-minute/tuyere. The consumption of fuel oil per ton of copper refined would be lower for a converter of higher capacity; at this time, the flow rate of fuel oil per tuyere would be only slightly higher. For such a converter, tuyeres of greater diameter would be necessary. In general, where the nunber of tuyeres and the blowing time are constant, the consumption of fuel oil is proportional to the diameter of the tuyeres, while the flow rate of oxygen and thus the tonnage of copper treated are approximately proportional to the square to the diameter.

What is claimed is:

1. A process for refining molten copper matte in a refractory-lined converter having at least one double tuyere located beneath the surface of the molten bath, which process comprises the steps of:

oxidizing the iron component of said copper matte by injecting an oxidizing gas having an oxygen content of from 21% to pure oxygen into said matte through said tuyere at a pressure in the range of 6 to 20 bars to maintain the temperature of said matte in the range of 1280° C to 1420° C, while also injecting through said tuyere a cooling agent peripherally of said oxidizing gas; and thereafter oxidizing the sulfur component of said copper matte by injecting an oxidizing gas enriched with oxygen to the extent of being 40% oxygen or greater into said matte through said tuyere at a pressure in the range of 6 to 20 bars to maintain the temperature of said matte in the range of 1280° C to 1420° C, while also injecting through said tuyere a cooling agent peripherally of said oxidizing gas.

2. A process as recited in claim 1 wherein: said cooling agent is a carbon-containing material.

3. A process as recited in claim 2 wherein: said carbon-containing material is fuel oil.

4. A process as recited in claim 3 wherein: said oxidizing gas is injected at a pressure in the range of 6 to 10 bars.

5. A process as recited in claim 3 wherein:

said temperature of said matte is maintained in the range of 1350° C to 1400° C during said steps of oxidizing said iron component and oxidizing said sulfur component.

6. A process as recited in claim 3 wherein:

said step of oxidizing said iron component comprises a plurality of blowing periods each being interrupted for slag removal from said converter and additional charging operations.

7. A process as recited in claim 6 wherein:

each of said blowing periods is commenced by an initial period of injecting pure oxygen as said oxidizing gas followed by a reduction in the oxygen content of said oxidizing gas for the balance of said blowing period.

8. A process as recited in claim 7 wherein:

said oxidizing gas blown during said balance of said blowing period is highly enriched with oxygen.

* * * * *

UNITED STATES PATENT AND TRADEMARK OFFICE

CERTIFICATE OF CORRECTION

PATENT NO. : 3,990,890

DATED : November 9, 1976

INVENTOR(S) : Pierre Leroy

It is certified that error appears in the above-identified patent and that said Letters Patent are hereby corrected as shown below:

Column 2, line 48, "tmperature" should read --temperature--

Column 3, line 42, "one" should --ore--

Column 4, line 21, "a" (second occurrence) should read --of--; line 32, "acieve" should read --achieve--; line 47, "to" should read --in--; line 65, "increasing" should read --increased--

Column 6, line 34, "changed" should read --charged--; line 68, "changed" should read --charged--

Column 7, line 23, "of" should be deleted; line 27, --of oxygen-- should be inserted after "1,300 $Nm^3$"' line 41, "this" should read --the same--; line 48, "the" , second occurrence, should read -- this --.

Column 8, line 8, --up-- should be inserted after "21%"

Signed and Sealed this

Twenty-second Day of March 1977

[SEAL]

*Attest:*

RUTH C. MASON
*Attesting Officer*

C. MARSHALL DANN
*Commissioner of Patents and Trademarks*